US008002912B2

(12) United States Patent
Pandey

(10) Patent No.: US 8,002,912 B2
(45) **Date of Patent: *Aug. 23, 2011**

(54) HIGH STRENGTH L12 ALUMINUM ALLOYS

(75) Inventor: Awadh B. Pandey, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 409 days.

This patent is subject to a terminal disclaimer.

(21) Appl. No.: 12/148,459

(22) Filed: Apr. 18, 2008

(65) Prior Publication Data

US 2009/0260722 A1 Oct. 22, 2009

(51) Int. Cl.
*C22C 21/00* (2006.01)

(52) U.S. Cl. ..... 148/437; 420/550; 420/551

(58) Field of Classification Search ..... None
See application file for complete search history.

(56) References Cited

U.S. PATENT DOCUMENTS

| | | | |
|---|---|---|---|
| 3,619,181 | A | 11/1971 | Willey |
| 3,816,080 | A | 6/1974 | Bomford et al. |
| 4,041,123 | A | 8/1977 | Lange et al. |
| 4,259,112 | A | 3/1981 | Dolowy, Jr. et al. |
| 4,463,058 | A | 7/1984 | Hood et al. |
| 4,469,537 | A | 9/1984 | Ashton et al. |
| 4,499,048 | A | 2/1985 | Hanejko |
| 4,597,792 | A | 7/1986 | Webster |
| 4,626,294 | A | 12/1986 | Sanders, Jr. |
| 4,647,321 | A | 3/1987 | Adam |
| 4,661,172 | A | 4/1987 | Skinner et al. |
| 4,667,497 | A | 5/1987 | Oslin et al. |
| 4,689,090 | A | 8/1987 | Sawtell et al. |
| 4,710,246 | A | 12/1987 | Le Caer et al. |
| 4,713,216 | A | 12/1987 | Higashi et al. |
| 4,755,221 | A | 7/1988 | Paliwal et al. |
| 4,834,810 | A | 5/1989 | Benn et al. |
| 4,834,942 | A | 5/1989 | Frazier et al. |
| 4,853,178 | A | 8/1989 | Oslin |
| 4,865,806 | A | 9/1989 | Skibo et al. |
| 4,874,440 | A | 10/1989 | Sawtell et al. |
| 4,915,605 | A | 4/1990 | Chan et al. |
| 4,927,470 | A | 5/1990 | Cho |
| 4,933,140 | A | 6/1990 | Oslin |
| 4,946,517 | A | 8/1990 | Cho |
| 4,964,927 | A | 10/1990 | Shiflet et al. |
| 4,988,464 | A | 1/1991 | Riley |
| 5,032,352 | A | 7/1991 | Meeks et al. |
| 5,053,084 | A | 10/1991 | Masumoto et al. |
| 5,055,257 | A | 10/1991 | Chakrabarti et al. |
| 5,059,390 | A | 10/1991 | Burleigh et al. |
| 5,066,342 | A | 11/1991 | Rioja et al. |
| 5,076,340 | A | 12/1991 | Bruski et al. |
| 5,076,865 | A | 12/1991 | Hashimoto et al. |
| 5,130,209 | A | 7/1992 | Das et al. |
| 5,133,931 | A | 7/1992 | Cho |
| 5,198,045 | A | 3/1993 | Cho et al. |
| 5,211,910 | A | 5/1993 | Pickens et al. |
| 5,226,983 | A | 7/1993 | Skinner et al. |
| 5,256,215 | A | 10/1993 | Horimura |
| 5,308,410 | A | 5/1994 | Horimura et al. |
| 5,312,494 | A | 5/1994 | Horimura et al. |
| 5,318,641 | A | 6/1994 | Masumoto et al. |
| 5,397,403 | A | 3/1995 | Horimura et al. |
| 5,458,700 | A | 10/1995 | Masumoto et al. |
| 5,462,712 | A | 10/1995 | Langan et al. |
| 5,480,470 | A | 1/1996 | Miller et al. |
| 5,597,529 | A | 1/1997 | Tack |
| 5,620,652 | A | 4/1997 | Tack et al. |
| 5,624,632 | A | 4/1997 | Baumann et al. |
| 5,882,449 | A | 3/1999 | Waldron et al. |
| 6,139,653 | A | 10/2000 | Fernandes et al. |
| 6,149,737 | A | 11/2000 | Hattori et al. |
| 6,248,453 | B1 | 6/2001 | Watson |
| 6,254,704 | B1 | 7/2001 | Laul et al. |
| 6,258,318 | B1 | 7/2001 | Lenczowski et al. |
| 6,309,594 | B1 | 10/2001 | Meeks, III et al. |
| 6,312,643 | B1 | 11/2001 | Upadhya et al. |
| 6,315,948 | B1 | 11/2001 | Lenczowski et al. |
| 6,331,218 | B1 | 12/2001 | Inoue et al. |
| 6,355,209 | B1 | 3/2002 | Dilmore et al. |
| 6,368,427 | B1 | 4/2002 | Sigworth |
| 6,506,503 | B1 | 1/2003 | Mergen et al. |
| 6,517,954 | B1 | 2/2003 | Mergen et al. |
| 6,524,410 | B1 | 2/2003 | Kramer et al. |
| 6,531,004 | B1 | 3/2003 | Lenczowski et al. |
| 6,562,154 | B1 | 5/2003 | Rioja et al. |
| 6,630,008 | B1 | 10/2003 | Meeks, III et al. |
| 6,702,982 | B1 | 3/2004 | Chin et al. |
| 6,902,699 | B2 | 6/2005 | Fritzemeier et al. |
| 6,918,970 | B2 | 7/2005 | Lee et al. |
| 6,974,510 | B2 | 12/2005 | Watson |
| 7,048,815 | B2 | 5/2006 | Senkov et al. |
| 7,097,807 | B1 | 8/2006 | Meeks, III et al. |
| 7,241,328 | B2 | 7/2007 | Keener |
| 7,344,675 | B2 | 3/2008 | Van Daam et al. |
| 2001/0054247 | A1 | 12/2001 | Stall et al. |
| 2003/0192627 | A1 | 10/2003 | Lee et al. |
| 2004/0046402 | A1 | 3/2004 | Winardi |
| 2004/0055671 | A1 | 3/2004 | Olson et al. |
| 2004/0089382 | A1 | 5/2004 | Senkov et al. |
| 2004/0170522 | A1 | 9/2004 | Watson |

(Continued)

FOREIGN PATENT DOCUMENTS

CN 1436870 A 8/2003

(Continued)

OTHER PUBLICATIONS

English Abstract of RU 2001144, published Oct. 15, 1993.*

(Continued)

*Primary Examiner* — George Wyszomierski
(74) *Attorney, Agent, or Firm* — Kinney & Lange, P.A.

(57) ABSTRACT

High temperature aluminum alloys that can be used at temperatures from about −420° F. (−251° C.) up to about 650° F. (343° C.) are described. The alloys are strengthened by dispersion of particles based on the $L1_2$ intermetallic compound $Al_3X$. These alloys comprise aluminum, at least one of nickel, iron and chromium; at least one of scandium, erbium, thulium, ytterbium, and lutetium, and at least one of gadolinium, yttrium, zirconium, titanium, hafnium, and niobium.

8 Claims, 8 Drawing Sheets

U.S. PATENT DOCUMENTS

| | | | |
|---|---|---|---|
| 2004/0191111 | A1 | 9/2004 | Nie et al. |
| 2005/0013725 | A1 | 1/2005 | Hsiao |
| 2005/0147520 | A1 | 7/2005 | Canzona |
| 2006/0011272 | A1 | 1/2006 | Lin et al. |
| 2006/0093512 | A1 | 5/2006 | Pandey |
| 2006/0172073 | A1 | 8/2006 | Groza et al. |
| 2006/0269437 | A1 | 11/2006 | Pandey |
| 2007/0048167 | A1 | 3/2007 | Yano |
| 2007/0062669 | A1 | 3/2007 | Song et al. |
| 2008/0066833 | A1 | 3/2008 | Lin et al. |

FOREIGN PATENT DOCUMENTS

| | | | |
|---|---|---|---|
| CN | 101205578 | A | 6/2008 |
| EP | 0 208 631 | A1 | 6/1986 |
| EP | 0 584 596 | A2 | 8/1993 |
| EP | 1 111 079 | A1 | 6/2001 |
| EP | 1 249 303 | A1 | 10/2002 |
| EP | 1 170 394 | B1 | 4/2004 |
| EP | 1 439 239 | A1 | 7/2004 |
| EP | 1 471 157 | A1 | 10/2004 |
| EP | 1 111 078 | B1 | 9/2006 |
| EP | 1728881 | A2 | 12/2006 |
| EP | 1 788 102 | A1 | 5/2007 |
| EP | 2110452 | A1 | 10/2009 |
| FR | 2 656 629 | A1 | 12/1990 |
| FR | 2843754 | A1 | 2/2004 |
| JP | 04218638 | A | 12/1990 |
| JP | 9104940 | A | 4/1997 |
| JP | 9279284 | A | 10/1997 |
| JP | 11156584 | A | 6/1999 |
| JP | 00119786 | A | 4/2000 |
| JP | 2001038442 | A | 2/2001 |
| JP | 2007188878 | A | 7/2007 |
| RU | 2001144 | C1 | 10/1993 |
| RU | 2001145 | C1 | 10/1993 |
| WO | 90 02620 | A1 | 3/1990 |
| WO | 91 10755 | A2 | 7/1991 |
| WO | 91 11540 | A1 | 8/1991 |
| WO | WO 96/10099 | | 4/1996 |
| WO | 9833947 | A1 | 8/1998 |
| WO | 0037696 | A1 | 6/2000 |
| WO | 0112868 | A1 | 2/2001 |
| WO | 02 29139 | A2 | 4/2002 |
| WO | 03 052154 | A1 | 6/2003 |
| WO | 03085145 | A2 | 10/2003 |
| WO | 03085146 | A1 | 10/2003 |
| WO | WO03104505 | A2 | 12/2003 |
| WO | 2004005562 | A2 | 1/2004 |
| WO | 2004046402 | A2 | 6/2004 |
| WO | 2005045080 | A1 | 5/2005 |
| WO | 2005047554 | A1 | 5/2005 |

OTHER PUBLICATIONS

Official Search Report of the European Patent Office in counterpart foreign Application No. 09250969 filed Mar. 31, 2009.

Gangopadhyay, A. K. and Kelton, K. F. "Effect of rare-earth atomic radius on the devitrification of Al88RE8Ni4 amorphous alloys." Philosophical Magazine. May 5, 2000. vol. 80. No. 5. pp. 1193-1206.

Tian, N., Ohnuma, M. and Hono, K. "Heating rate dependence of glass transition and primary crystallization of Al88Gd6Er2Ni4 metallic glass." Scripta Sep. 9, 2005. vol. 53 pp. 681-685 Materialia Published by Elsevier Ltd.

Neikov et al. "Properties of Rapidly Solidified Powder Aluminum Alloys for Elevated Temperatures Produced by Water Atomization." Advances in Powder Metallurgy & Particulate Materials. I. M. Frantezvych Institute for Problems of Material Science. Air Force Research Laboratory. 2002.

Lotsko et al. "High-Strength Aluminum-Based Alloys Hardened by Quasicrystalline Nanoparticles." Perspective Materials of Functional and Structural Purposes: Possibilities of Obtaining New Level of Properties. I. M. Frantsevych Institute for Problems of Material Science of Nasz of Ukraine, Kyyiv, Ukiraine. Air Force Research Laboratory, Materials and Manufacturing directorate, Wright Patterson, USA. Jul. 27, 2009.

Niu, Ben et al: "Influence of addition of 1-15 erbium on microstructure and crystallization behavior of Al-Ni-Y amorphous alloy" Zhongguo Xitu Xuebao, 26(4), 450-454 Coden: ZXXUE5; ISSN: 1000-4343, 2008, XP09120693.

Cook, R., et al. "Aluminum and Aluminum Alloy Powders for P/M Applications." The Aluminum Powder Company Limited, Ceracon Inc., Jan. 2007.

"Aluminum and Aluminum Alloys." ASM Specialty Handbook. 1993. ASM International. p. 559.

ASM Handbook, vol. 7 ASM International, Materials Park, OH (1993) p. 396.

Riddle, Y.W., et al. "Improving Recrystallization Resistance in WRought Aluminum Alloys with Scandium Addition." Lightweight Alloys for Aerospace Applications VI (pp. 26-39), 2001 TMS Annual Meeting, New Orleans, Louisiana, Feb. 11-15, 2001.

Baikowski Malakoff Inc. "The many uses of High Purity Alumina." Technical Specs. http://www.baikowskimalakoff.com/pdf/Rc-Ls.pdf (2005).

Lotsko, D.V., et al. "Effect of small additions of transition metals on the structure of Al-Zn-Mg-Zr-Sc alloys." New Level of Properties. Advances in Insect Physiology. Academic Press, vol. 2, Nov. 4, 2002. pp. 535-536.

Harada, Y. et al. "Microstructure of Al3Sc with ternary transition-metal additions." Materials Science and Engineering A329-331 (2002) 686-695.

Unal, A. et al. "Gas Atomization" from the section "Production of Aluminum and Aluminum-Alloy Powder" ASM Handbook, vol. 7. 2002.

Riddle, Y.W., et al. "A Study of Coarsening, Recrystallization, and Morphology of Microstructure in Al-Sc-(Zr)-(Mg) Alloys." Metallurgical and Materials Transactions A. vol. 35A, Jan. 2004. pp. 341-350.

Mil'Man, Y.V. et al. "Effect of Additional Alloying with Transition Metals on the STructure of an Al-7.1 Zn-1.3 Mg-0.12 Zr Alloy." Metallofizika I Noveishie Teknohologii, 26 (10), 1363-1378, 2004.

Litynska, L. et al. "Experimental and theoretical characterization of Al3Sc precipitates in Al-Mg-Si-Cu-Sc-Zr alloys." Zeitschrift Fur Metallkunde. vol. 97, No. 3. Jan. 1, 2006. pp. 321-324.

Rachek, O.P. "X-ray diffraction study of amorphous alloys Al-Ni-Ce-Sc with using Ehrenfest's formula." Journal of Non-Crystalline Solids 352 (2006) pp. 3781-3786.

Pandey A B et al, "High Strength Discontinuously Reinforced Aluminum for Rocket Applications," Affordable Metal Matrix Composites for High Performance Applications. Symposia Proceedings, TMS (The Minerals, Metals & Materials Society), US, No. 2nd, Jan. 1, 2008 , pp. 3-12.

Riddle, Y.W., et al. "Recrystallization Performance of AA7050 Varied with Sc and Zr." Materials Science Forum. 2000. pp. 799-804.

Hardness Conversion Table. Downloaded from http://www.gordonengland.co.uk/hardness/hardness_conversion2m.htm.

Cabbibo, M. et al., A TEM study of the combined effect of severe plastic deformation and (Zr), (Sc+Zr)-containing dispersoids on an Al-Mg-Si alloy.' Journal of Materials Science, vol. 41, Nol. 16, Jun. 6, 2006. pp. 5329-5338.

Litynska-Dobrzynska, L. "Effect of heat treatment on the sequence of phases formation in Al-Mg-Si alloy with Sc and Zr additions." Archives of Metallurgy and Materials. 51 (4), pp. 555-560, 2006.

Litynska-Dobrzynska, L. "Precipitation of Phases in Al-Mg-Si-Cu Alloy with Sc and Zr and Zr Additions During Heat Treatment" Diffusion and Defect Data, Solid State Data, Part B, Solid Statephenomena. vol. 130, No. Applied Crystallography, Jan. 1, 2007. pp. 163-166.

* cited by examiner

HIGH STRENGTH L12 ALUMINUM ALLOYS

CROSS-REFERENCE TO RELATED APPLICATIONS

This application is related to the following co-pending applications that are filed on even date herewith and are assigned to the same assignee: $L1_2$ ALUMINUM ALLOYS WITH BIMODAL AND TRIMODAL DISTRIBUTION, Ser. No. 12/148,395, DISPERSION STRENGTHENED $L1_2$ ALUMINUM ALLOYS, Ser. No. 12/148,432, HEAT TREATABLE $L1_2$ ALUMINUM ALLOYS, Ser. No. 12/148,383, HIGH STRENGTH $L1_2$ ALUMINUM ALLOYS, Ser. No. 12/148,394, now U.S. Pat. No. 7,871,477, HIGH STRENGTH $L1_2$ ALUMINUM ALLOYS, Ser. No. 12/148,382, now U.S. Pat. No. 7,811,395, HEAT TREATABLE $L1_2$ ALUMINUM ALLOYS, Ser. No. 12/148,396, now U.S. Pat. No. 7,875,133, HIGH STRENGTH $L1_2$ ALUMINUM ALLOYS, Ser. No. 12/148,387, HIGH STRENGTH ALUMINUM ALLOYS WITH $L1_2$ PRECIPITATES, Ser. No. 12/148,426, now U.S. Pat. No. 7,879,162, and $L1_2$ STRENGTHENED AMORPHOUS ALUMINUM ALLOYS, Ser. No. 12/148,458, now U.S. Pat. No. 7,875,131.

BACKGROUND

The present invention relates generally to aluminum alloys and more specifically to aluminum alloys that are strengthened by $L1_2$ phase dispersions that are useful for applications at temperatures from about −420° F. (−251° C.), to about 650° F. (343° C.).

The combination of high strength, ductility, and fracture toughness, as well as low density, make aluminum alloys natural candidates for aerospace and space applications. However, their use is typically limited to temperatures below about 300° F. (149° C.) since most aluminum alloys start to lose strength in that temperature range as a result of coarsening of strengthening precipitates.

The development of aluminum alloys with improved elevated temperature mechanical properties is a continuing process. Some attempts have included aluminum-iron and aluminum-chromium based alloys such as Al—Fe—Ce, Al—Fe—V—Si, Al—Fe—Ce—W, and Al—Cr—Zr—Mn that contain incoherent dispersoids. These alloys, however, also lose strength at elevated temperatures due to particle coarsening. In addition, these alloys exhibit ductility and fracture toughness values lower than other commercially available aluminum alloys.

Other attempts have included the development of mechanically alloyed Al—Mg and Al—Ti alloys containing ceramic dispersoids. These alloys exhibit improved high temperature strength due to the particle dispersion, but the ductility and fracture toughness are not improved.

U.S. Pat. No. 6,248,453 discloses aluminum alloys strengthened by dispersed $Al_3X$ $L1_2$ intermetallic phases where X is selected from the group consisting of Sc, Er, Lu, Yb, Tm, and U. The $Al_3X$ particles are coherent with the aluminum alloy matrix and are resistant to coarsening at elevated temperatures. The improved mechanical properties of the disclosed dispersion strengthened $L1_2$ aluminum alloys are stable up to 572° F. (300° C.). $L1_2$ dispersion strengthened aluminum alloys with improved mechanical properties at cryogenic temperatures as well as at temperatures greater than 572° F. (300° C.) would be useful.

Heat treatable aluminum alloys strengthened by coherent $L1_2$ intermetallic phases produced by standard, inexpensive melt processing techniques would also be useful.

SUMMARY

The present invention is aluminum alloys that have superior strength, ductility and fracture toughness at temperatures from about −420° F. (−251° C.) up to about 650° F. (343° C.).

The alloys comprise nickel, iron, chromium and coherent $Al_3X$ $L1_2$ dispersoids where X is at least one element selected from scandium, erbium, thulium, ytterbium, and lutetium, and at least one element selected from gadolinium, yttrium, zirconium, titanium, hafnium, and niobium. The balance is substantially aluminum.

These alloys also comprise at least one of nickel, iron or chromium. The balance is substantially aluminum.

The alloys have less than about 1.0 weight percent total impurities.

The alloys can be formed by any rapid solidification technique wherein the cooling rate exceeds $10^{3°}$ C./second that includes atomization, melt spinning, splat quenching, spray deposition, cold spray, plasma spray, laser melting, ball milling, and cryomilling.

The alloys can be heat treated at a temperature of about 800° F. (426° C.) to about 1,100° F. (593° C.) for about 30 minutes to four hours, followed by quenching in liquid and thereafter aged at a temperature of about 200° F. (93° C.) to about 600° F. (315° C.) for about two to about forty-eight hours.

DETAILED DESCRIPTION

This invention relates to aluminum alloys that have superior strength, ductility, and fracture toughness for applications at temperatures from about −420° F. (−251° C.) up to about 650° F. (343° C.). These aluminum alloys comprise alloying elements that have been selected because they have low diffusion coefficients in aluminum, they have low solid solubility in aluminum, and they can form dispersoids that have low interfacial energy with aluminum. Solid solution alloying is beneficial because it provides additional strengthening and greater work hardening capability, which results in improved failure strain and toughness.

The alloys of this invention comprise aluminum, nickel, iron, chromium strengthened by having dispersed therein a fine, coherent $L1_2$ phase based on $Al_3X$ where X is least one first element selected from scandium, erbium, thulium, ytterbium, and lutetium, and at least one second element selected from gadolinium, yttrium, zirconium, titanium, hafnium, and niobium.

Alloying elements such as nickel, iron, and chromium may be added to derive dispersion and/or solid solution strengthening that is thermally stable at high temperatures. In embodiments nickel may be added because it forms thermally stable spherical $Al_3Ni$ dispersoids, and in powder form nickel can be undercooled at relatively large levels (as compared to iron and chromium) by controlling the powder processing parameters. While nickel is preferred in some embodiments, other elements such as iron or chromium can be used in place of, or in addition to, nickel.

Figure 1:
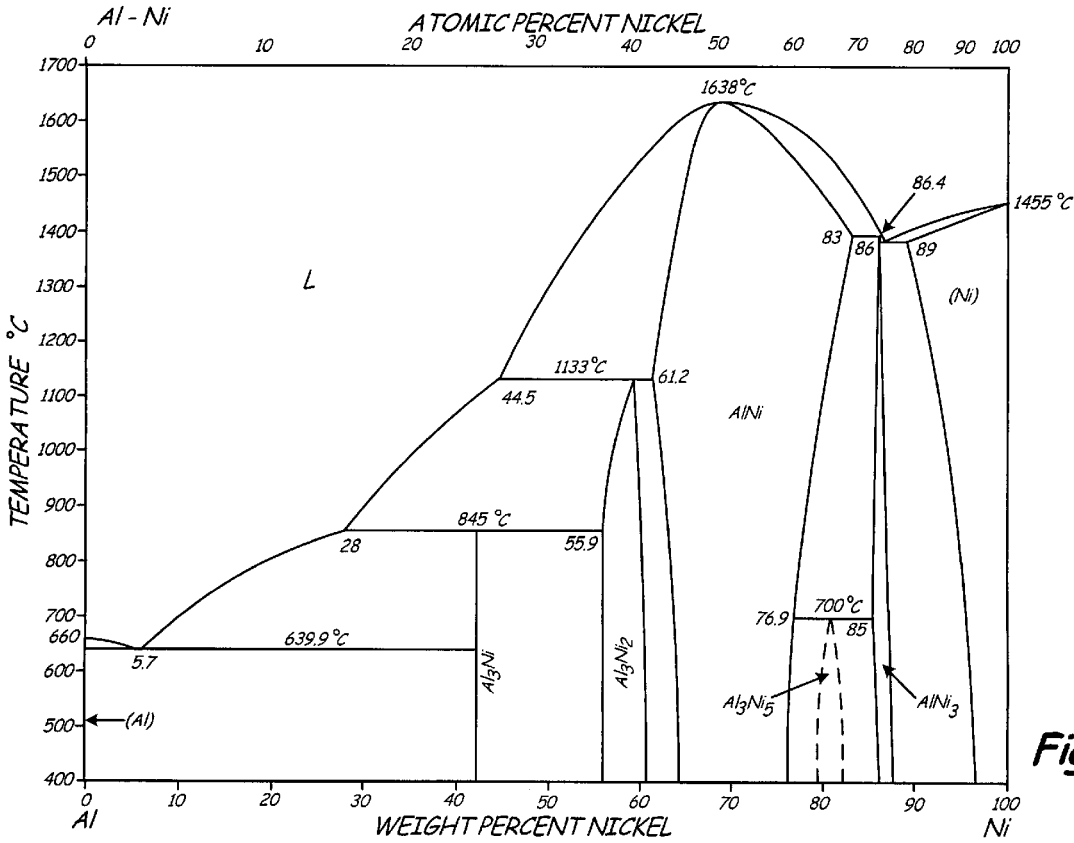
FIG. 1 is an aluminum nickel phase diagram.

The aluminum nickel phase diagram is shown in FIG. 1. The aluminum nickel binary system is a simple eutectic at 5.7 weight percent nickel and 1183.8° F. (639.9° C.) resulting in a mixture of a solid solution of nickel and aluminum, and $Al_3Ni$ dispersoids. There is little solubility of nickel in aluminum. However, the solubility can be extended significantly by utilizing rapid solidification processes. The equilibrium phase in the aluminum nickel eutectic system is $Al_3Ni$ dispersoids. Nickel is added to the alloys of this invention for two reasons. First solid solution strengthening is derived from the nickel. Second the $Al_3Ni$ dispersoids help dispersion strengthen the alloy. The aluminum solid solution in $Al_3Ni$ dispersoids are thermally stable, which contributes to the high temperature strengthening of the alloys. Rapid solidification techniques will be preferred to increase the supersaturation of nickel and decrease the size of the dispersoids, which thereby provides higher strength to the alloy.

Figure 2:
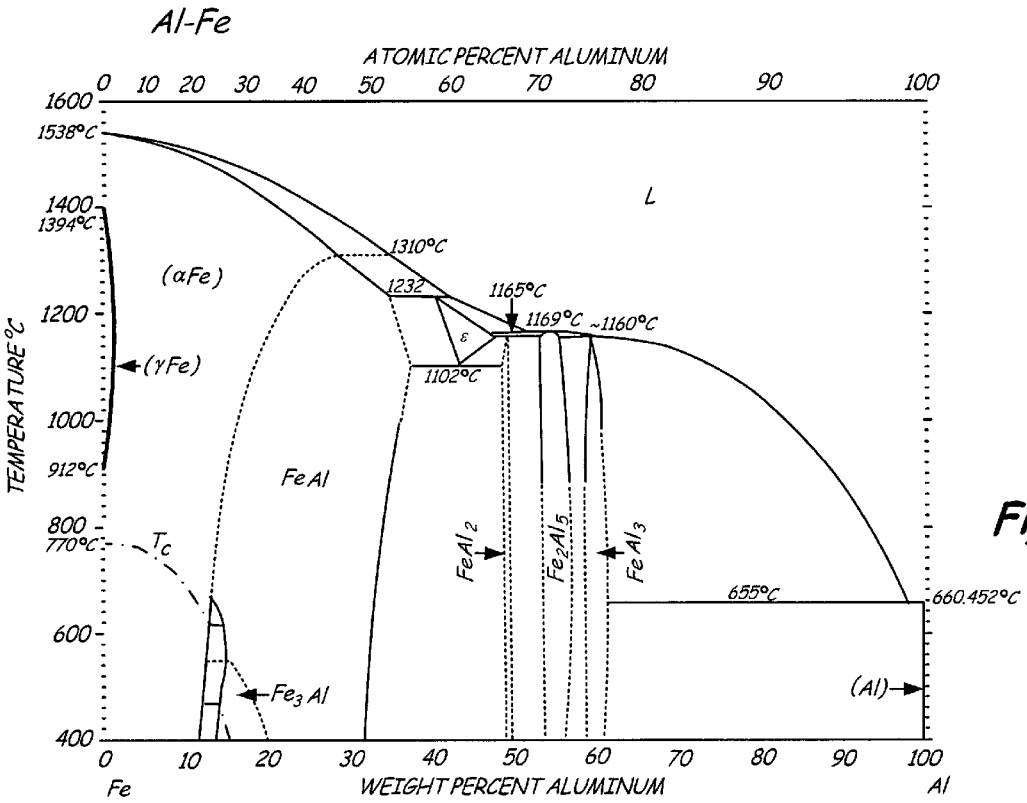
FIG. 2 is an aluminum iron phase diagram.

The aluminum iron phase diagram is shown in FIG. 2. The aluminum iron binary system is a simple eutectic at about 1.5 weight percent iron and 1211° F. (655° C.) resulting in a mixture of a solid solution of iron and aluminum, and $Al_3Fe$ dispersoids. Iron forms $Al_6Fe$ dispersoids in the aluminum matrix in the metastable condition. The solid solubility of iron in aluminum is low which can be increased significantly by utilizing rapid solidification processing. Iron is added to the alloys of this invention for two reasons. First solid solution strengthening is derived from the iron. Second the $Al_3Fe$ dispersoids help dispersion strengthen the alloy. The aluminum solid solution and $Al_3Fe$ dispersoids are thermally stable, which contributes to the high temperature strengthening of the alloys. Rapid solidification techniques will be preferred to increase the supersaturation of iron and decrease the size of the dispersoids, which thereby provides higher strength to the alloy.

Figure 3:
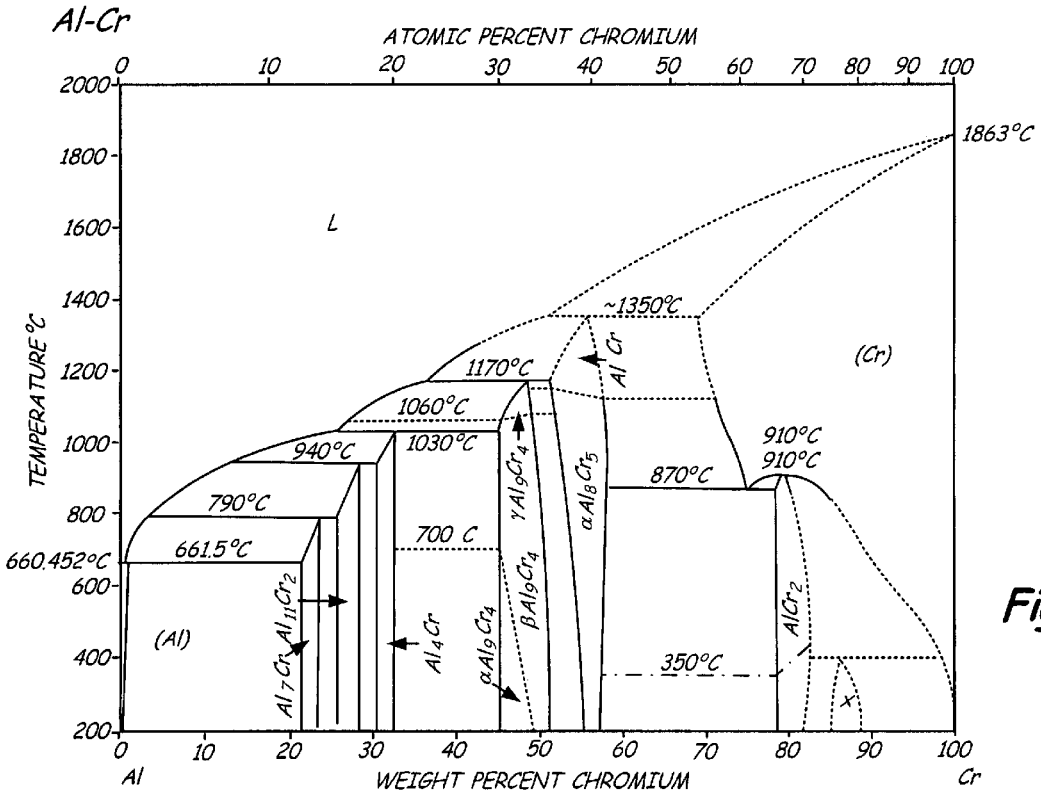
FIG. 3 is an aluminum chromium phase diagram.

The aluminum chromium phase diagram is shown in FIG. 3. The Al—Cr system forms a peritectic reaction with the aluminum where the reaction of liquid and $Al_{11}Cr_2$ results in $Al_7Cr$ dispersoids and a solid solution of chromium and aluminum. The amount of chromium present depends on the solubility of chromium in aluminum. Chromium has limited solubility in aluminum, but its solubility can be extended significantly by utilizing rapid solidification techniques. Rapid solidification techniques will be preferred to increase the supersaturation of chromium and decrease the size of the dispersoids, which thereby provides higher strength to the alloy.

In embodiments, there may be approximately 5 to 40 volume percent of fine $Al_3X$ based dispersoids present in order to provide the desired high strength at temperatures up to about 650° F. (343° C.). Some embodiments comprise about 10 to about 30 volume percent, or even more preferably about 15 to about 25 volume percent, of fine $Al_3X$ based dispersoids. However, depending upon the size of the dispersoids, higher or lower volume percents of $Al_3X$ based dispersoids may be present to provide balanced strength, ductility and toughness at temperatures up to about 650° F. (343° C.).

Scandium forms $Al_3Sc$ dispersoids that are fine and coherent with the aluminum matrix. Lattice parameters of aluminum and $Al_3Sc$ are very close (0.405 nm and 0.410 nm respectively), indicating that there is minimal or no driving force for causing growth of the $Al_3Sc$ dispersoids. This low interfacial energy makes the $Al_3Sc$ dispersoids thermally stable and resistant to coarsening up to temperatures as high as about 842° F. (450° C.). In the alloys of this invention these $Al_3Sc$ dispersoids are made stronger and more resistant to coarsening at elevated temperatures by adding suitable alloying elements such as gadolinium, yttrium, zirconium, titanium, hafnium, niobium, or combinations thereof, that enter $Al_3Sc$ in solution.

Erbium forms $Al_3Er$ dispersoids in the aluminum matrix that are fine and coherent with the aluminum matrix. The lattice parameters of aluminum and $Al_3Er$ are close (0.405 nm and 0.417 nm respectively), indicating there is minimal driving force for causing growth of the $Al_3Er$ dispersoids. This low interfacial energy makes the $Al_3Er$ dispersoids thermally stable and resistant to coarsening up to temperatures as high as about 842° F. (450° C.). In the alloys of this invention, these $Al_3Er$ dispersoids are made stronger and more resistant to coarsening at elevated temperatures by adding suitable alloying elements such as gadolinium, yttrium, zirconium, titanium, hafnium, niobium, or combinations thereof that enter $Al_3Er$ in solution.

Thulium forms metastable $Al_3Tm$ dispersoids in the aluminum matrix that are fine and coherent with the aluminum matrix. The lattice parameters of aluminum and $Al_3Tm$ are close (0.405 nm and 0.420 nm respectively), indicating there is minimal driving force for causing growth of the $Al_3Tm$ dispersoids. This low interfacial energy makes the $Al_3Tm$ dispersoids thermally stable and resistant to coarsening up to temperatures as high as about 842° F. (450° C.). In the alloys of this invention these $Al_3Tm$ dispersoids are made stronger and more resistant to coarsening at elevated temperatures by adding suitable alloying elements such as gadolinium, yttrium, zirconium, titanium, hafnium, niobium, or combinations thereof that enter $Al_3Tm$ in solution.

Ytterbium forms $Al_3Yb$ dispersoids in the aluminum matrix that are fine and coherent with the aluminum matrix. The lattice parameters of Al and $Al_3Yb$ are close (0.405 nm and 0.420 nm respectively), indicating there is minimal driving force for causing growth of the $Al_3Yb$ dispersoids. This low interfacial energy makes the $Al_3Yb$ dispersoids thermally stable and resistant to coarsening up to temperatures as high as about 842° F. (450° C.). In the alloys of this invention, these $Al_3Yb$ dispersoids are made stronger and more resistant to coarsening at elevated temperatures by adding suitable alloying elements such as gadolinium, yttrium, zirconium, titanium, hafnium, niobium, or combinations thereof that enter $Al_3Yb$ in solution.

Lutetium forms $Al_3Lu$ dispersoids in the aluminum matrix that are fine and coherent with the aluminum matrix. The lattice parameters of Al and $Al_3Lu$ are close (0.405 nm and 0.419 nm respectively), indicating there is minimal driving force for causing growth of the $Al_3Lu$ dispersoids. This low interfacial energy makes the $Al_3Lu$ dispersoids thermally stable and resistant to coarsening up to temperatures as high as about 842° F. (450° C.). In the alloys of this invention, these $Al_3Lu$ dispersoids are made stronger and more resistant to coarsening at elevated temperatures by adding suitable alloying elements such as gadolinium, yttrium, zirconium, titanium, hafnium, niobium, or mixtures thereof that enter $Al_3Lu$ in solution.

Gadolinium forms metastable $Al_3Gd$ dispersoids in the aluminum matrix that are stable up to temperatures as high as about 842° F. (450° C.) due to their low diffusivity in aluminum. The $Al_3Gd$ dispersoids have an $L1_2$ structure in the metastable condition and a $D0_{19}$ structure in the equilibrium condition. Despite its large atomic size, gadolinium has fairly high solubility in the $Al_3X$ intermetallic dispersoids (where X is scandium, erbium, thulium, ytterbium or lutetium). Gadolinium can substitute for the X atoms in $Al_3X$ intermetallic, thereby forming an ordered $L1_2$ phase which results in improved thermal and structural stability.

Yttrium forms metastable $Al_3Y$ dispersoids in the aluminum matrix that have an $L1_2$ structure in the metastable condition and a $D0_{19}$ structure in the equilibrium condition. The metastable $Al_3Y$ dispersoids have a low diffusion coefficient which makes them thermally stable and highly resistant to coarsening. Yttrium has a high solubility in the $Al_3X$ intermetallic dispersoids allowing large amounts of yttrium to substitute for X in the $Al_3X$ $L1_2$ dispersoids which results in improved thermal and structural stability.

Zirconium forms $Al_3Zr$ dispersoids in the aluminum matrix that have an $L1_2$ structure in the metastable condition and $D0_{23}$ structure in the equilibrium condition. The metastable $Al_3Zr$ dispersoids have a low diffusion coefficient which makes them thermally stable and highly resistant to coarsening. Zirconium has a high solubility in the $Al_3X$ dispersoids allowing large amounts of zirconium to substitute for X in the $Al_3X$ dispersoids, which results in improved thermal and structural stability.

Titanium forms $Al_3Ti$ dispersoids in the aluminum matrix that have an $L1_2$ structure in the metastable condition and $DO_{22}$ structure in the equilibrium condition. The metastable $Al_3Ti$ despersoids have a low diffusion coefficient which makes them thermally stable and highly resistant to coarsening. Titanium has a high solubility in the $Al_3X$ dispersoids allowing large amounts of titanium to substitute for X in the $Al_3X$ dispersoids, which result in improved thermal and structural stability.

Hafnium forms metastable $Al_3Hf$ dispersoids in the aluminum matrix that have an $L1_2$ structure in the metastable condition and a $D0_{23}$ structure in the equilibrium condition. The $Al_3Hf$ dispersoids have a low diffusion coefficient, which makes them thermally stable and highly resistant to coarsening. Hafnium has a high solubility in the $Al_3X$ dispersoids allowing large amounts of hafnium to substitute for scandium, erbium, thulium, ytterbium, and lutetium in the above mentioned $Al_3X$ dispersoides, which results in stronger and more thermally stable dispersoids.

Niobium forms metastable $Al_3Nb$ dispersoids in the aluminum matrix that have an $L1_2$ structure in the metastable condition and a $D0_{22}$ structure in the equilibrium condition. Niobium has a lower solubility in the $Al_3X$ dispersoids than hafnium or yttrium, allowing relatively lower amounts of niobium than hafnium or yttrium to substitute for X in the $Al_3X$ dispersoids. Nonetheless, niobium can be very effective in slowing down the coarsening kinetics of the $Al_3X$ dispersoids because the $Al_3Nb$ dispersoids are thermally stable. The substitution of niobium for X in the above mentioned $Al_3X$ dispersoids results in stronger and more thermally stable dispersoids.

The amount of nickel present in the matrix of this invention may vary from about 4 to about 25 weight percent, more preferably from about 6 to about 20 weight percent, and even more preferably from about 8 to about 15 weight percent.

The amount of iron present in the matrix of this invention may vary from about 1.5 to about 20 weight percent, more preferably from about 4 to about 15 weight percent, and even more preferably from about 6 to about 10 weight percent.

The amount of chromium present in the matrix of this invention may vary from about 1 to about 20 weight percent, more preferably from about 2 to about 15 weight percent, and even more preferably from about 4 to about 10 weight percent.

Figure 4:
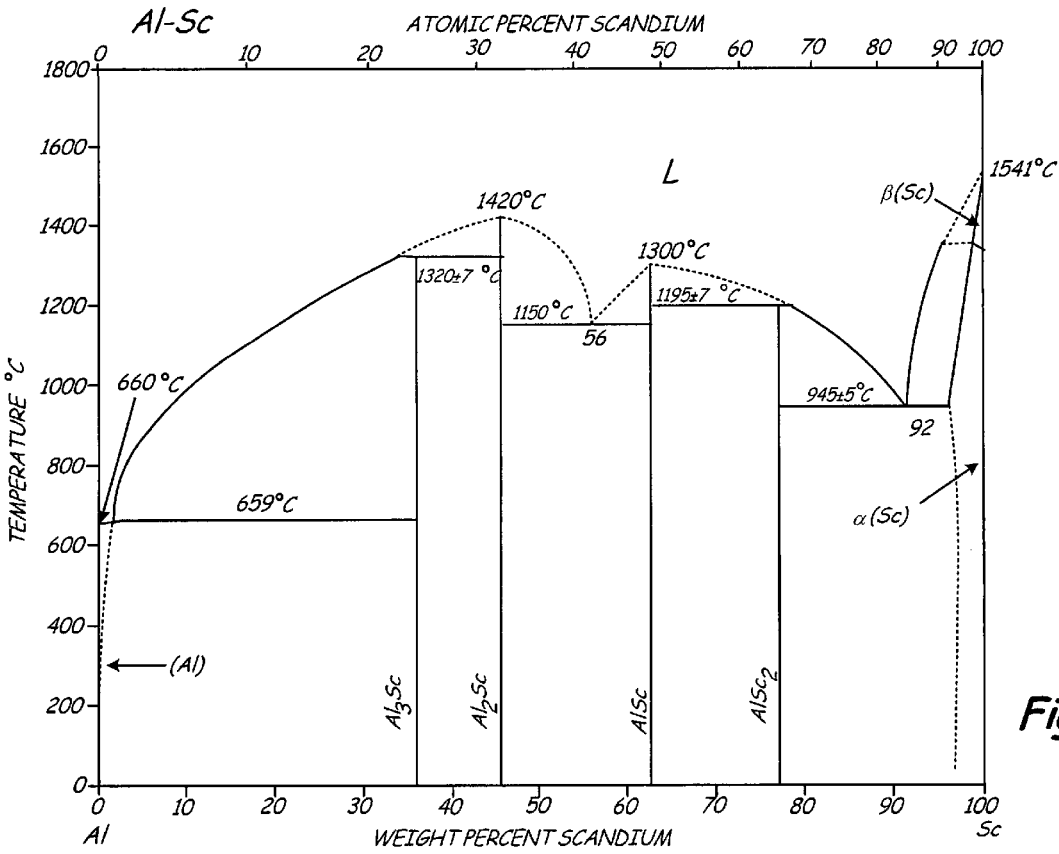
FIG. 4 is an aluminum scandium phase diagram.

The amount of scandium present in the alloys of this invention if any may vary from about 0.1 to about 4 weight percent, more preferably from about 0.1 to about 3 weight percent, and even more preferably from about 0.2 to about 2.5 weight percent. The Al—Sc phase diagram shown in FIG. 4 indicates a eutectic reaction at about 0.5 weight percent scandium at about 1219° F. (659° C.) resulting in a solid solution of scandium and aluminum and $Al_3Sc$ dispersoids. Aluminum alloys with less than 0.5 weight percent scandium can be quenched from the melt to retain scandium in solid solution that may precipitate as dispersed $L1_2$ intermetallic $Al_3Sc$ following an aging treatment. Alloys with scandium in excess of the eutectic composition (hypereutectic alloys) can only retain scandium in solid solution by rapid solidification processing (RSP) where cooling rates are in excess of about $10^{3\circ}$ C./second. Alloys with scandium in excess of the eutectic composition cooled normally will have a microstructure consisting of relatively large $Al_3Sc$ grains in a finally divided aluminum-$Al_3Sc$ eutectic phase matrix.

Figure 5:
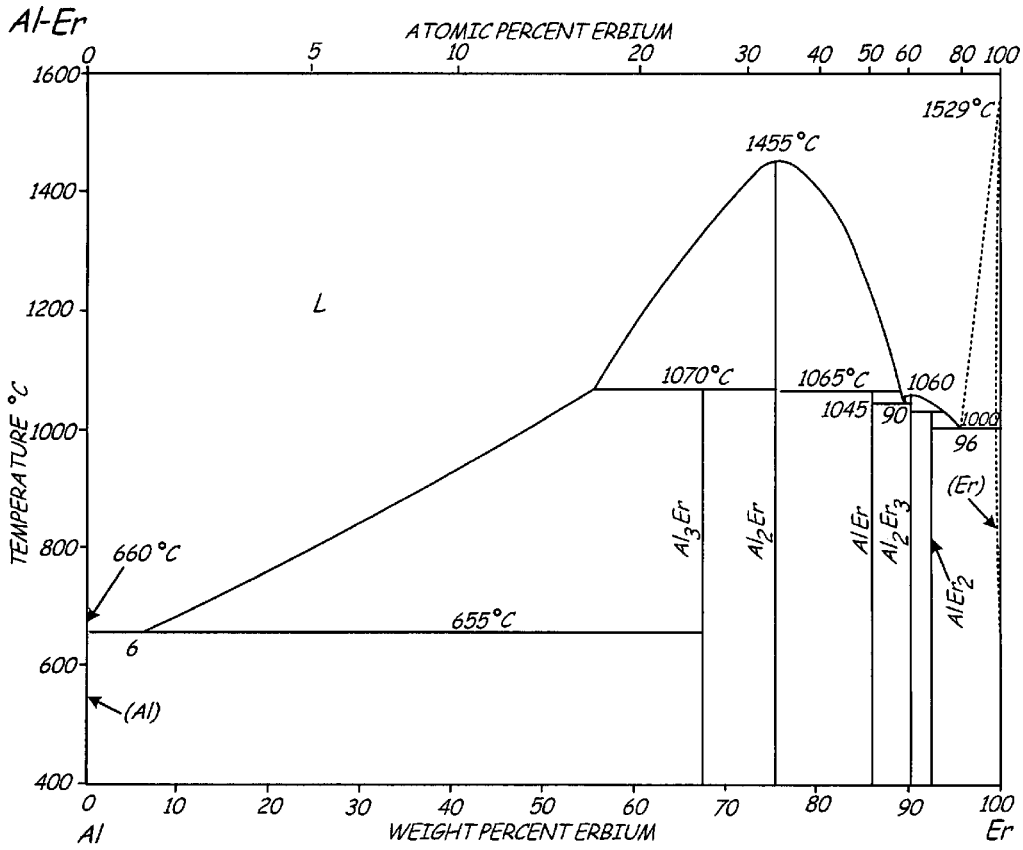
FIG. 5 is an aluminum erbium phase diagram.

The amount of erbium present in the alloys of this invention, if any, may vary from about 0.1 to about 20 weight percent, more preferably from about 0.3 to about 15 weight percent, and even more preferably from about 0.5 to about 10 weight percent. The Al—Er phase diagram shown in FIG. 5 indicates a eutectic reaction at about 6 weight percent erbium at about 1211° F. (655° C.). Aluminum alloys with less than about 6 weight percent erbium can be quenched from the melt to retain erbium in solid solutions that may precipitate as dispersed $L1_2$ intermetallic $Al_3Er$ following an aging treatment. Alloys with erbium in excess of the eutectic composition can only retain erbium in solid solution by rapid solidification processing (RSP) where cooling rates are in excess of about $10^{3\circ}$ C./second. Alloys with erbium in excess of the eutectic composition cooled normally will have a microstructure consisting of relatively large $Al_3Er$ grains in a finely divided aluminum-$Al_3Er$ eutectic phase matrix.

Figure 6:
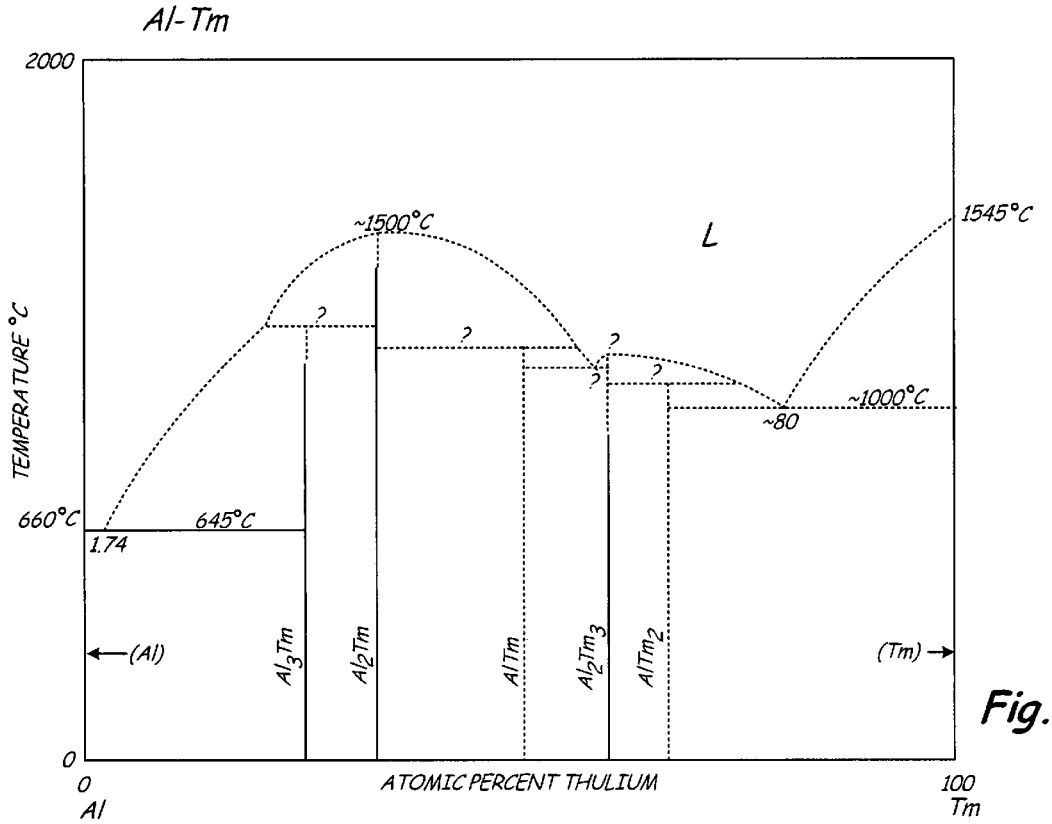
FIG. 6 is an aluminum thulium phase diagram.

The amount of thulium present in the alloys of this invention, if any, may vary from about 0.1 to about 15 weight percent, more preferably from about 0.2 to about 10 weight percent, and even more preferably from about 0.4 to about 6 weight percent. The Al—Tm phase diagram shown in FIG. 6 indicates a eutectic reaction at about 10 weight percent thulium at about 1193° F. (645° C.). Thulium forms metastable $Al_3Tm$ dispersoids in the aluminum matrix that have an $L1_2$ structure in the equilibrium condition. The $Al_3Tm$ dispersoids have a low diffusion coefficient which makes them thermally stable and highly resistant to coarsening. Aluminum alloys with less than 10 weight percent thulium can be quenched from the melt to retain thulium in solid solution that may precipitate as dispersed metastable $L1_2$ intermetallic $Al_3Tm$ following an aging treatment. Alloys with thulium in excess of the eutectic composition can only retain Tm in solid solution by rapid solidification processing (RSP) where cooling rates are in excess of about $10^{3\circ}$ C./second.

Figure 7:
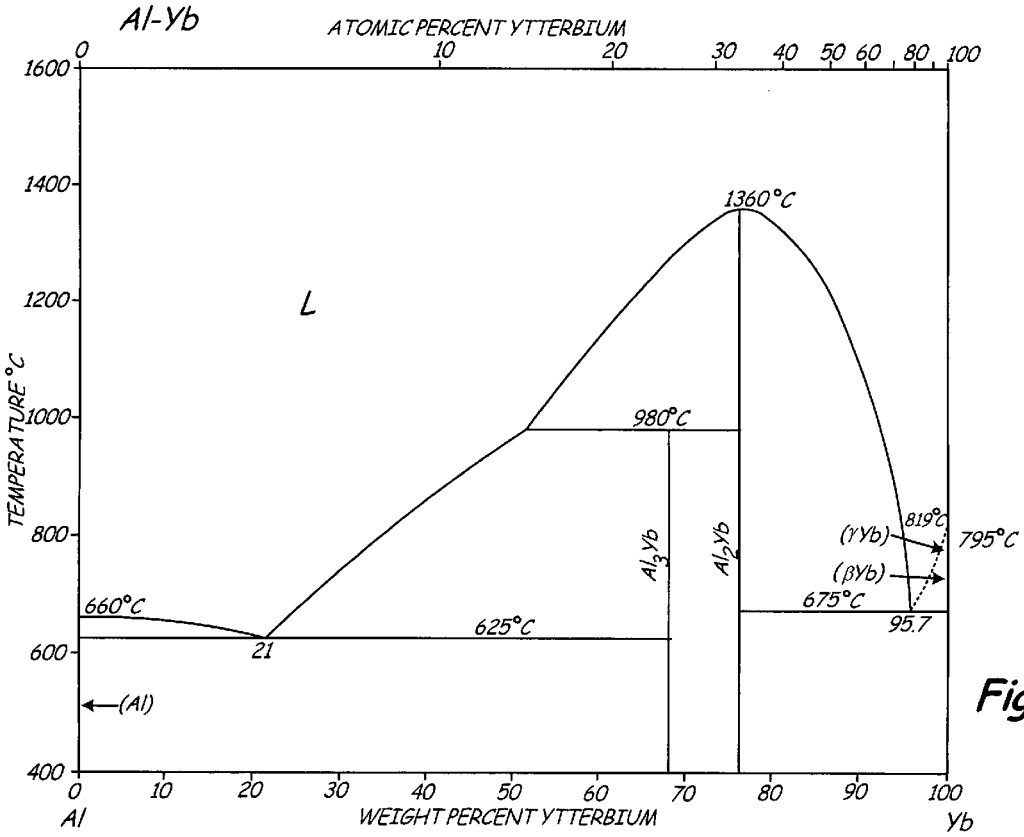
FIG. 7 is an aluminum ytterbium phase diagram.

The amount of ytterbium present in the alloys of this invention, if any, may vary from about 0.1 to about 25 weight percent, more preferably from about 0.3 to about 20 weight percent, and even more preferably from about 0.4 to about 10 weight percent. The Al—Yb phase diagram shown in FIG. 7 indicates a eutectic reaction at about 21 weight percent ytterbium at about 1157° F. (625° C.). Aluminum alloys with less than about 21 weight percent ytterbium can be quenched from the melt to retain ytterbium in solid solution that may precipitate as dispersed $L1_2$ intermetallic $Al_3Yb$ following an aging treatment. Alloys with ytterbium in excess of the eutectic composition can only retain ytterbium in solid solution by rapid solidification processing (RSP) where cooling rates are in excess of about $10^{3\circ}$ C./second.

Figure 8:
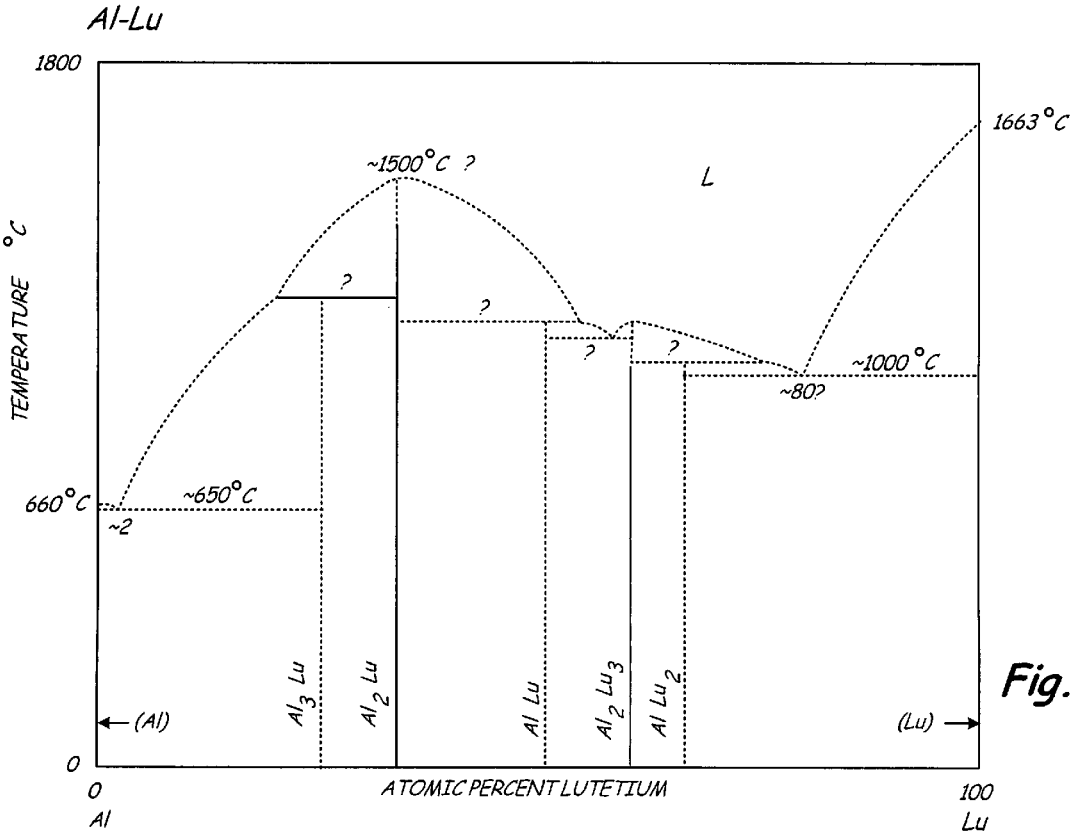
FIG. 8 is an aluminum lutetium phase diagram.

The amount of lutetium present in the alloys of this invention, if any, may vary from about 0.1 to about 25 weight percent, more preferably from about 0.3 to about 20 weight percent, and even more preferably from about 0.4 to about 10 weight percent. The Al—Lu phase diagram shown in FIG. 8 indicates a eutectic reaction at about 11.7 weight percent Lu at about 1202° F. (650° C.). Aluminum alloys with less than about 11.7 weight percent lutetium can be quenched from the melt to retain Lu in solid solution that may precipitate as dispersed $L1_2$ intermetallic $Al_3Lu$ following an aging treatment. Alloys with Lu in excess of the eutectic composition can only retain Lu in solid solution by rapid solidification processing (RSP) where cooling rates are in excess of about $10^{3}$° C./second.

The amount of gadolinium present in the alloys of this invention, if any, may vary from about 2 to about 30 weight percent, more preferably from about 4 to about 25 weight percent, and even more preferably from about 6 to about 20 weight percent.

The amount of yttrium present in the alloys of this invention, if any, may vary from about 2 to about 30 weight percent, more preferably from about 4 to about 25 weight percent, and even more preferably from about 6 to about 20 weight percent.

The amount of zirconium present in the alloys of this invention, if any, may vary from about 0.5 to about 5 weight percent, more preferably from about 1 to about 4 weight percent, and even more preferably from about 1 to about 3 weight percent.

The amount of titanium present in the alloys of this invention, if any, may vary from about 0.5 to about 10 weight percent, more preferably from about 1 to about 8 weight percent, and even more preferably from about 1 to about 4 weight percent.

The amount of hafnium present in the alloys of this invention, if any, may vary from about 0.5 to about 10 weight percent, more preferably from about 1 to about 8 weight percent, and even more preferably from about 1 to about 4 weight percent.

The amount of niobium present in the alloys of this invention, if any, may vary from about 0.5 to about 5 weight percent, more preferably from about 1 to about 4 weight percent, and even more preferably from about 1 to about 3 weight percent.

Exemplary aluminum alloys of this invention include, but are not limited to (in weight percent):

about Al-(4-25)Ni-(0.1-4)Sc-(2-30)Gd;
about Al-(4-25)Ni-(0.1-20)Er-(2-30)Gd;
about Al-(4-25)Ni-(0.1-15)Tm-(2-30)Gd;
about Al-(4-25)Ni-(0.1-25)Lu-(2-30)Gd;
about Al-(4-25)Ni-(0.1-25)Yb-(2-30)Gd;
about Al-(4-25)Ni-(0.1-4)Sc-(2-30)Y;
about Al-(4-25)Ni-(0.1-20)Er-(2-30)Y;
about Al-(4-25)Ni-(0.1-15)Tm-(2-30)Y;
about Al-(4-25)Ni-(0.1-25)Lu-(2-30)Y;
about Al-(4-25)Ni-(0.1-25)Yb-(2-30)Y;
about Al-(4-25)Ni-(0.1-4)Sc-(0.5-5)Zr;
about Al-(4-25)Ni-(0.1-20)Er-(0.5-5)Zr;
about Al-(4-25)Ni-(0.1-15)Tm)-(0.5-5)Zr;
about Al-(4-25)Ni-(0.1-25)Lu)-(0.5-5)Zr;
about Al-(4-25)Ni-(0.1-25)Yb-(0.5-5)Zr;
about Al-(4-25)Ni-(0.1-4)Sc-(0.5-10)Ti;
about Al-(4-25)Ni-(0.1-20)Er-(0.5-10)Ti;
about Al-(4-25)Ni-(0.1-15)Tm-(0.5-10)Ti;
about Al-(4-25)Ni-(0.1-25)Lu-(0.5-10)Ti;
about Al-(4-25)Ni-(0.1-25)Yb-(0.5-10)Ti;
about Al-(4-25)Ni-(0.1-4)Sc-(0.5-10)Hf;
about Al-(4-25)Ni-(0.1-20)Er-(0.5-10)Hf;
about Al-(4-25)Ni-(0.1-15)Tm-(0.5-10)Hf;
about Al-(4-25)Ni-(0.1-25)Lu)-(0.5-10)Hf;
about Al-(4-25)Ni-(0.1-25)Yb-(0.5-10)Hf;
about Al-(4-25)Ni-(0.1-4)Sc-(0.5-5)Nb;
about Al-(4-25)Ni-(0.1-20Er)-(0.5-5)Nb;
about Al-(4-25)Ni-(0.1-15)Tm-(0.5-5)Nb;
about Al-(4-25)Ni-(0.1-25)Lu-(0.5-5)Nb; and
about Al-(4-25)Ni-(0.1-25)Yb-(0.5-5)Nb.

Similar to these alloys, the alloys may also contain iron and/or chromium in place of or in addition to nickel. The amount of iron present in the matrix of this invention may vary from about 1.5 to about 20 weight percent, more preferably from about 4 to about 15 weight percent, and even more preferably from about 6 to about 10 weight percent. The amount of chromium present in the matrix of this invention may vary from about 1 to about 20 weight percent, more preferably from about 2 to about 15 weight percent, and even more preferably from about 4 to about 10 weight percent.

In the inventive aluminum based alloys disclosed herein, scandium forms an equilibrium $Al_3Sc$ intermetallic dispersoid that has an $L1_2$ structure that is an ordered face centered cubic structure with the Sc atoms located at the corners and aluminum atoms located on the cube faces of the unit cell.

In order to have the best properties for the alloys of this invention, it is desirable to limit the amount of other elements. Specific elements that should be reduced or eliminated include no more that about 0.1 weight percent manganese, 0.1 weight percent vanadium, and 0.1 weight percent cobalt. The total quantity of additional elements should not exceed about 1% by weight, including the above listed impurities and other elements.

These aluminum alloys may be made by rapid solidification processing. The rapid solidification process should have a cooling rate greater that about $10^{3}$° C./second including but not limited to powder processing, atomization, melt spinning, splat quenching, spray deposition, cold spray, plasma spray, laser melting and deposition, ball milling and cryomilling.

These aluminum alloys may be made in various forms (i.e. ribbon, flake, powder, et cetera) by any rapid solidification technique that can provide supersaturation of the elements such as, but not limited to, melt spinning, splat quenching, spray deposition, vacuum plasma spraying, cold spraying, laser melting, mechanical alloying, ball milling (i.e. at room temperature), cryomilling (in a liquid nitrogen environment) spin forming or atomization. Any processing technique utilizing cooling rates equivalent to or higher than about $10^{3}$° C./second is considered to be a rapid solidification technique for these alloys. Therefore, the minimum desired cooling rate for the processing of these alloys is about $10^{3}$° C./second, although higher cooling rates may be necessary for alloys having larger amounts of alloying additions.

Atomization may be the preferred technique for creating embodiments of these alloys. Atomization is one of the most common rapid solidification techniques used to produce large volumes of powder. The cooling rate experienced during atomization depends on the powder size and usually varies from about $10^{3}$° C./second to about $10^{5}$° C./second. Helium gas atomization is often desirable because helium gas provides higher heat transfer coefficients, which leads to higher cooling rates in the powder. Fine sized powders (i.e. about −325 mesh) may be desirable so as to achieve maximum supersaturation of the alloying elements that can precipitate out during powder processing.

Cryomilling may be the preferred technique for creating other embodiments of these alloys. Cryomilling introduces oxynitride particles in the powder that can provide additional strengthening to the alloy at high temperatures by increasing the threshold stress or dislocation climb. Additionally, the nitride particles, when located on grain boundaries, can reduce the grain boundaries sliding in the alloy by pinning the dislocation, which results in reduced dislocation ability in the grain boundary.

Once the alloyed composition (i.e. ribbon, flake, powder, et cetera) is created, and after suitable vacuum degassing, the powder, ribbon, flake, et cetera, can be compacted in any suitable manner, such as, for example, by vacuum hot pressing, or blind dye compaction (where compaction occurs in both by sheer deformation) or by hot isostatic pressing (where compaction occurs by deflusional creep).

After compaction, the alloy may be extruded, forged, or rolled to impart deformation thereto, which is important for achieving the best mechanical properties in the alloy. In embodiments, extrusion ratios ranging from about 10:1 to about 22:1 may be desired. In some embodiments, low extrusion ratios (i.e., about 2:1 to about 9:1) may be useful. Hot vacuum degassing, vacuum hot pressing, and extrusion may be carried out at any suitable temperature, such as for example at about 572-842° F. (300-450° C.).

More exemplary aluminum alloys of this invention include, but are not limited to (in weight percent):

about Al-(6-20)Ni-(0.1-3)Sc-(4-25)Gd;
about Al-(6-20)Ni-(0.3-15)Er-(4-25)Gd;
about Al-(6-20)Ni-(0.2-10)Tm)-(4-25)Gd;
about Al-(6-20)Ni-(0.3-20)Lu)-(4-25)Gd;
about Al-(6-20)Ni-(0.3-20)Yb-(4-25)Gd;
about Al-(6-20)Ni-(0.1-3)Sc-(4-25)Y;
about Al-(6-20)Ni-(0.3-15)Er-(4-25)Y;
about Al-(6-20)Ni-(0.2-10)Tm)-(4-25)Y;
about Al-(6-20)Ni-(0.3-20)Lu)-(4-25)Y;
about Al-(6-20)Ni-(0.3-20)Yb-(4-25)Y;
about Al-(6-20)Ni-(0.1-3)Sc-(1-4)Zr;
about Al-(6-20)Ni-(0.3-15)Er-(1-4)Zr;
about Al-(6-20)Ni-(0.2-10)Tm)-(1-4)Zr;
about Al-(6-20)Ni-(0.3-20)Lu)-(1-4)Zr;
about Al-(6-20)Ni-(0.3-20)Yb-(1-4)Zr;
about Al-(6-20)Ni-(0.1-3)Sc-(1-8)Ti;
about Al-(6-20)Ni-(0.3-15)Er-(1-8)Ti;
about Al-(6-20)Ni-(0.2-10)Tm-(1-8)Ti;
about Al-(6-20)Ni-(0.3-20)Lu-(1-8)Ti;
about Al-(6-20)Ni-(0.3-20)Yb-(1-8)Ti;
about Al-(6-20)Ni-(0.1-3)Sc-(1-8)Hf;
about Al-(6-20)Ni-(0.3-15)Er-(1-8)Hf;
about Al-(6-20)Ni-(0.2-10)Tm-(1-8)Hf;
about Al-(6-20)Ni-(0.3-20)Lu-(1-8)Hf;
about Al-(6-20)Ni-(0.3-20)Yb-(1-8)Hf;
about Al-(6-20)Ni-(0.1-3)Sc-(1-4)Nb;
about Al-(6-20)Ni-(0.3-15)Er-(1-4)Nb;
about Al-(6-20)Ni-(0.2-10)Tm-(1-4)Nb;
about Al-(6-20)Ni-(0.3-20)Lu-(1-4)Nb; and
about Al-(6-20)Ni-(0.3-20)Yb-(1-4)Nb.

Similar to these alloys, the alloys may also contain iron and/or chromium in place of or in addition to nickel. The amount of iron present in the matrix of this invention may vary from about 1.5 to about 20 weight percent, more preferably from about 4 to about 15 weight percent, and even more preferably from about 6 to about 10 weight percent. The amount of chromium present in the matrix of this invention may vary from about 1 to about 20 weight percent, more preferably from about 2 to about 15 weight percent, and even more preferably from about 4 to about 10 weight percent.

Even more preferred exemplary aluminum alloys of this invention include, but are not limited to (in weight percent):

about Al-(8-15)Ni-(0.2-2.5)Sc-(6-20)Gd;
about Al-(8-15)Ni-(0.5-10)Er-(6-20)Gd;
about Al-(8-15)Ni-(0.4-6)Tm-(6-20)Gd;
about Al-(8-15)Ni-(0.4-10)Lu-(6-20)Gd;
about Al-(8-15)Ni-(0.4-10)Yb-(6-20)Gd;
about Al-(8-15)Ni-(0.2-2.5)Sc-(6-20)Y;
about Al-(8-15)Ni-(0.5-10)Er-(6-20)Y;
about Al-(8-15)N-(0.4-6)Tm-(6-20)Y;
about Al-(8-15)Ni-(0.4-10)Lu-(6-20)Y;
about Al-(8-15)Ni-(0.4-10)Yb-(6-20)Y;
about Al-(8-15)Ni-(0.2-2.5)Sc-(1-3)Zr;
about Al-(8-15)Ni-(0.5-10)Er-(1-3)Zr;
about Al-(8-15)Ni-(0.4-6)Tm-(1-3)Zr;
about Al-(8-15)Ni-(0.4-10)Lu-(1-3)Zr;
about Al-(8-15)Ni-(0.4-10)Yb-(1-3)Zr;
about Al-(8-15)Ni-(0.2-2.5)Sc-(1-4)Ti;
about Al-(8-15)Ni-(0.5-10)Er-(1-4)Ti;
about Al-(8-15)Ni-(0.4-6)Tm-(1-4)Ti;
about Al-(8-15)Ni-(0.4-10)Lu-(1-4)Ti;
about Al-(8-15)Ni-(0.4-10)Yb-(1-4)Ti;
about Al-(8-15)Ni-(0.2-2.5)Sc-(1-4)Hf;
about Al-(8-15)Ni-(0.5-10)Er-(1-4)Hf;
about Al-(8-15)Ni-(0.4-6)Tm-(1-4)Hf;
about Al-(8-15)Ni-(0.4-10)Lu-(1-4)Hf;
about Al-(8-15)Ni-(0.4-10)Yb-(1-4)Hf;
about Al-(8-15)Ni-(0.2-2.5)Sc-(1-3)Nb;
about Al-(8-15)Ni-(0.5-10)Er-(1-3)Nb;
about Al-(8-15)Ni-(0.4-6)Tm-(1-3)Nb;
about Al-(8-15)Ni-(0.4-10)Lu-(1-3)Nb; and
about Al-(8-15)Ni-(0.4-10)Yb-(1-3)Nb.

Similar to these alloys, the alloys may also contain iron and/or chromium in place of or in addition to nickel. The amount of iron present in the matrix of this invention may vary from about 1.5 to about 20 weight percent, more preferably from about 4 to about 15 weight percent, and even more preferably from about 6 to about 10 weight percent. The amount of chromium present in the matrix of this invention may vary from about 1 to about 20 weight percent, more preferably from about 2 to about 15 weight percent, and even more preferably from about 4 to about 10 weight percent.

Although the present invention has been described with reference to preferred embodiments, workers skilled in the art will recognize that changes may be made in form and detail without departing from the spirit and scope of the invention.

The invention claimed is:

1. An aluminum alloy having high strength, ductility, corrosion resistance and fracture toughness, comprising:

at least one of about 4 to about 25 weight percent of nickel, about 1.5 to about 20 weight percent of iron, and about 1 to about 20 weight percent chromium;

at least one first element selected from the group consisting of: about 0.1 to about 4 weight percent scandium, about 0.1 to about 15 weight percent thulium, about 0.1 to about 25 weight percent ytterbium, and about 0.1 to about 25 weight percent lutetium;

at least one second element selected from the group consisting of: about 2 to about 30 weight percent yttrium, about 0.5 to about 5 weight percent zirconium, about 0.5 to about 10 weight percent titanium, about 0.5 to about 10 weight percent hafnium, and about 0.5 to about 5 weight percent niobium; and the balance substantially aluminum, whereby the alloy comprises:

an aluminum solid solution matrix and a plurality of dispersoids, the dispersoids comprising at least one of $Al_3Ni$, $Al_3Fe$, $Al_6Fe$, and $Al_3X$;

each $Al_3X$ dispersoid having a coherent $L1_2$ structure where X comprises at least one of scandium, thulium, ytterbium, and lutetium, and at least one of yttrium, zirconium, titanium, hafnium, and niobium; and wherein the alloy is formed by a rapid solidification process, wherein the rapid solidification process has a cooling rate greater that about $10^{3}$° C./second.

2. The aluminum alloy of claim 1, wherein the alloy is capable of being used at temperatures from about −420° F. (−251° C.) up to about 650° F. (343° C.).

3. The aluminum alloy of claim 1, wherein the aluminum alloy is used in at least one of: an aircraft component, a rocket component, and an automobile component.

4. The aluminum alloy of claim 1, wherein the rapid solidification technique comprises at least one of: melt spinning, splat quenching, atomization, spray deposition, vacuum plasma spraying, cold spraying, laser melting, mechanical alloying, cryomilling, spin forming, and ball milling.

5. The aluminum alloy of claim 1, wherein the rapid solidification technique comprises at least the following steps:

creating an ingot having a predetermined composition;

melting the ingot;

atomizing the melted ingot to form a powder;

degassing the powder;

compacting the powder to create a billet; and hot working the billet into a predetermined form.

6. The alloy of claim 1, comprising no more than about 1 weight percent total impurities.

7. The alloy of claim 1, comprising no more than about 0.1 weight percent manganese, about 0.1 weight percent vanadium, and about 0.1 weight percent cobalt.

8. An aluminum alloy having high strength, ductility, corrosion resistance and fracture toughness, comprising:

at least one of nickel, iron, and chromium;

at least one first element selected from the group consisting of: about 0.1 to about 4 weight percent scandium, about 0.1 to about 15 weight percent thulium, about 0.1 to about 25 weight percent ytterbium, and about 0.1 to about 25 weight percent lutetium;

at least one second element selected from the group consisting of: yttrium, zirconium, titanium, hafnium, and niobium; and the balance substantially aluminum, whereby the alloy comprises:

an aluminum solid solution matrix and a plurality of dispersoids, the dispersoids comprising at least one of $Al_3Ni$, $Al_3Fe$, $Al_6Fe$, and $Al_3X$;

each $Al_3X$ dispersoid having a coherent $L1_2$ structure where X comprises at least one of scandium, thulium, ytterbium, and lutetium, and at least one of yttrium, zirconium, titanium, hafnium, and niobium; and wherein the alloy is formed by a rapid solidification process, wherein the rapid solidification process has a cooling rate greater that about $10^{3}$° C./second.

* * * * *